US007367366B2

(12) United States Patent
Liao

(10) Patent No.: US 7,367,366 B2
(45) Date of Patent: May 6, 2008

(54) PUMPING DEVICE

(75) Inventor: Po-Lin Liao, Taichung (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 467 days.

(21) Appl. No.: 11/189,707

(22) Filed: Jul. 27, 2005

(65) Prior Publication Data

US 2007/0023365 A1 Feb. 1, 2007

(51) Int. Cl.

| | |
|---|---|
| ***B65B 1/04*** | (2006.01) |
| ***B65B 31/04*** | (2006.01) |
| ***F04B 23/14*** | (2006.01) |
| ***F04F 1/06*** | (2006.01) |

(52) U.S. Cl. ..... 141/26; 141/65; 417/85; 417/86; 417/118; 417/126; 417/127

(58) Field of Classification Search ..... 417/126, 417/118, 65, 85, 86, 127; 210/776; 184/1.5; 141/61, 95, 198, 26, 65

See application file for complete search history.

(56) References Cited

U.S. PATENT DOCUMENTS 1,713,517 A * 5/1929 Boe ..... 141/26
5,002,154 A * 3/1991 Chen ..... 184/1.5
5,405,247 A * 4/1995 Goodman ..... 417/139
5,450,924 A * 9/1995 Tseng ..... 184/1.5
6,112,759 A * 9/2000 Hsu ..... 137/148
6,357,492 B1 * 3/2002 Hsu ..... 141/26
6,474,443 B2 * 11/2002 Kearns et al. ..... 184/1.5
6,484,744 B1 * 11/2002 Tseng ..... 137/205
6,558,138 B2 * 5/2003 Tseng ..... 417/374
6,655,426 B2 * 12/2003 Shevela ..... 141/382
6,722,855 B2 * 4/2004 Tien-Tsai ..... 417/199.1
7,093,624 B2 * 8/2006 Chen ..... 141/65

* cited by examiner

*Primary Examiner*—David J. Isabella
*Assistant Examiner*—Rocco Italiano
(74) *Attorney, Agent, or Firm*—Bacon & Thomas, PLLC.

(57) ABSTRACT

A pumping device includes a container having a cover structure. A piston is movably received in the container and is manually operable. The cover structure has an air inlet valve and a slide switch, which, when properly set, allow air to be sucked into or expelled out of the container by the manual operation of the piston to increase or decrease the internal pressure of the container for oil suction and oil drainage. The pumping device also includes another slide switch, whereby when both slide switches are properly set, the internal pressure of the container is increased or decreased due to the supply of pressurized air from an external source and oil can be sucked into and drained out of the container accordingly.

5 Claims, 14 Drawing Sheets

PUMPING DEVICE

BACKGROUND OF THE INVENTION

1. Field of the Invention

The present invention relates generally to a pumping device, and in particular to a pumping device that can be manually or pneumatically operated to selectively suck liquid into a container and to drain the liquid out of the container.

2. The Related Art

Replacement and/or replenishment of oil is one of the most important jobs for maintenance and repairing of automobiles. Often, the oil is drained from the oil pan by simply removing the oil drain plug that blocks a drain hole formed in the bottom of the oil pan whereby oil is allowed to freely flow out of the drain hole. This is not an efficient way for draining oil from the automobile engine and may cause undesired contamination to the surroundings. Oil pumping devices or oil draining devices are available. However, such oil pumping devices have a complicated structure and can only be manually or pneumatically operated. In Taiwan Patent Application No. 90215858, filed by the present inventor, an oil pumping device that can be operated both manually and pneumatically is disclosed. However, such as conventional device still suffers certain drawbacks that can be further improved.

Thus, the present invention is aimed to provide a pumping device that overcomes the drawbacks of the conventional devices.

SUMMARY OF THE INVENTION

In an aspect of the present invention, a pumping device comprises an air inlet valve and a slide switch, which, when properly set, allows air to be sucked into or expelled out of a container to increase or decrease the internal pressure of the container for oil suction and oil drainage.

In another aspect of the present invention, under the supply of pressurized air from an external source, the pumping device comprises first and second slide switches that, when properly set, causes increase and decrease of the internal pressure of the container due to the supply of the pressurized air and oil can be sucked into and drained out of the container accordingly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
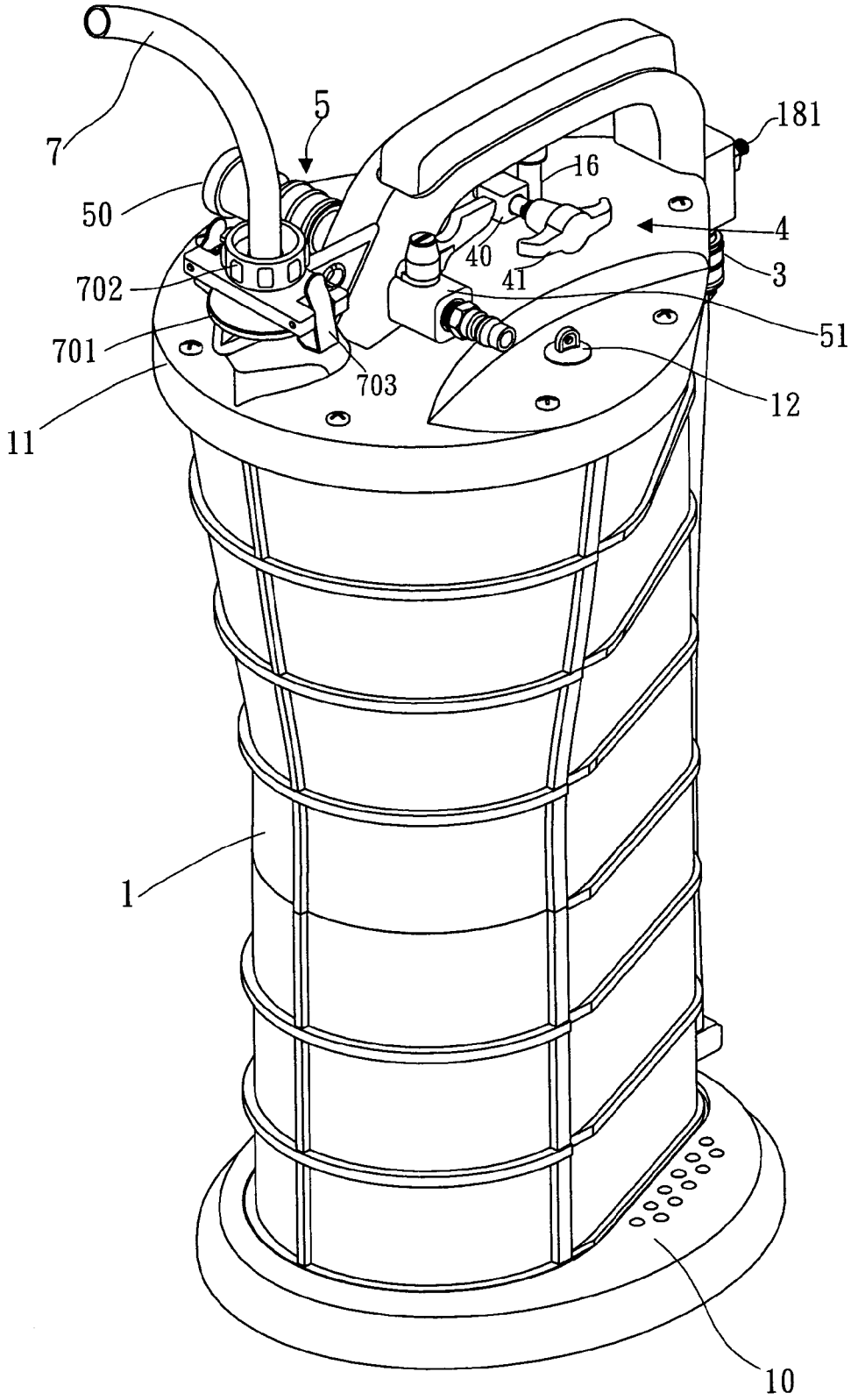
FIG. 1 is a perspective view of a pumping device constructed in accordance with the present invention.
Figure 2:
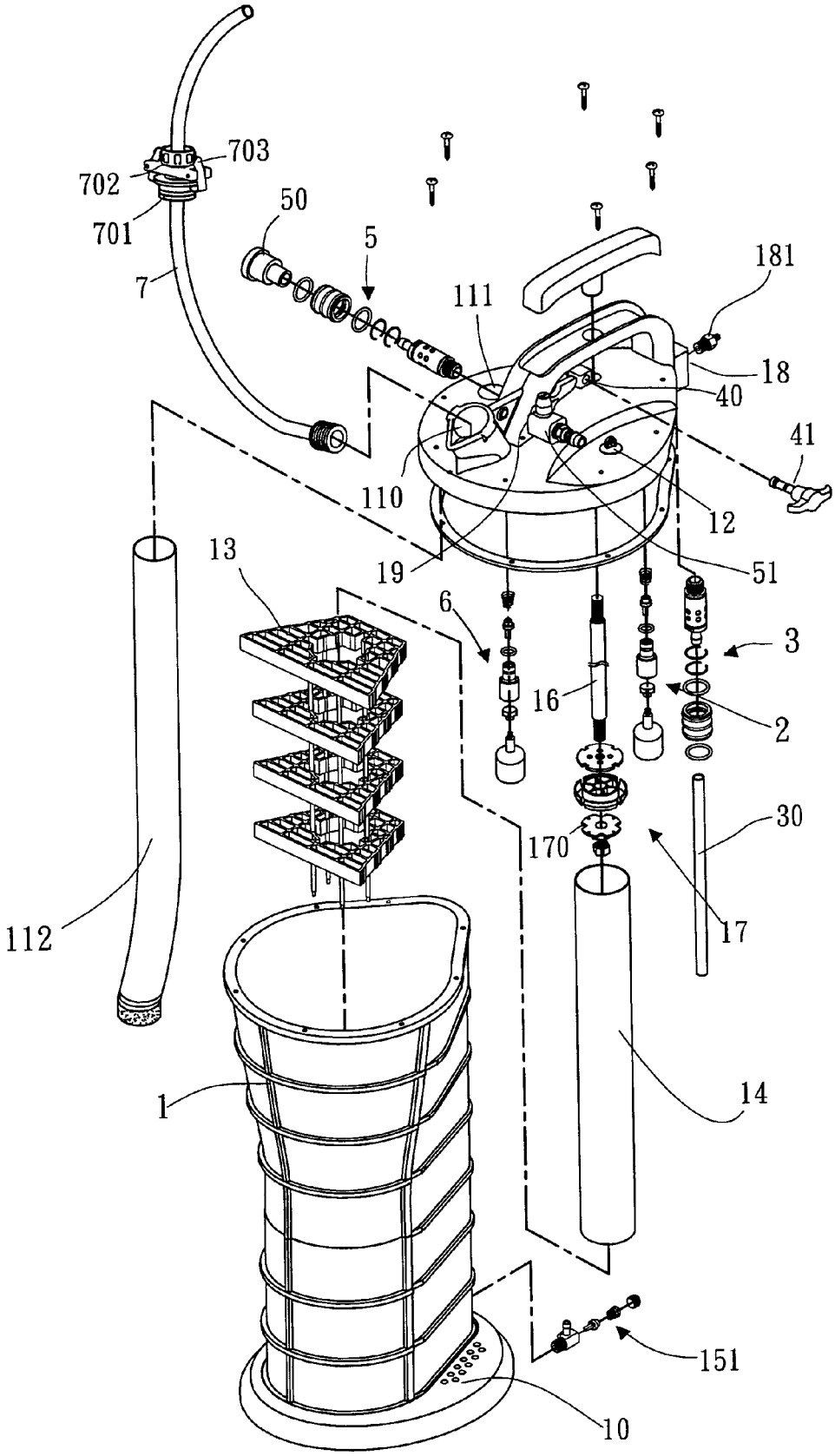
FIG. 2 is an exploded view of the pumping device of the present invention.

With reference to the drawings and in particular to FIGS. 1 and 2, a pumping device constructed in accordance with the present invention comprises a container body 1 having a bottom forming a base 10 that can be stepped on by a user's foot to fix the pumping device on a fixture surface during the operation of the pumping device. The container body 1 also has an open top to which a cover structure 11 is mounted.

Figure 3B:
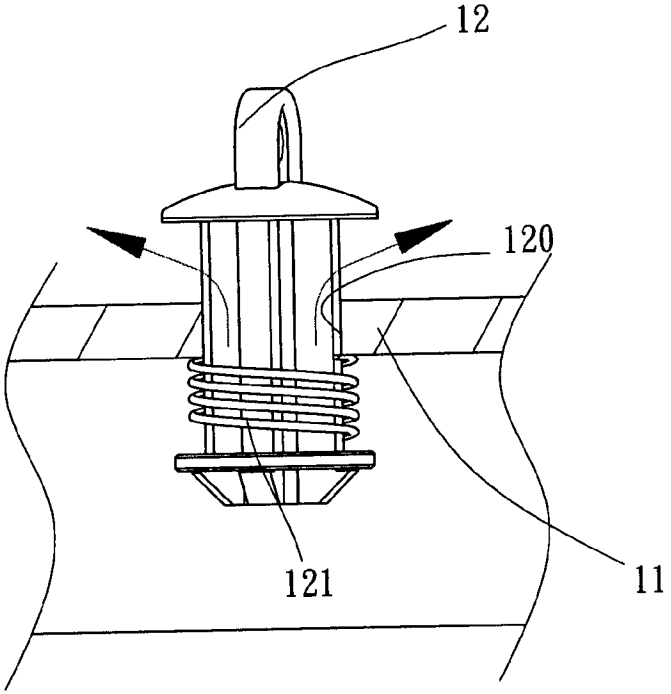
FIGS. 3A and 3B show a relief valve mounted on a cover structure of the pumping device in normally closed position and open position, respectively.
Figure 3A:
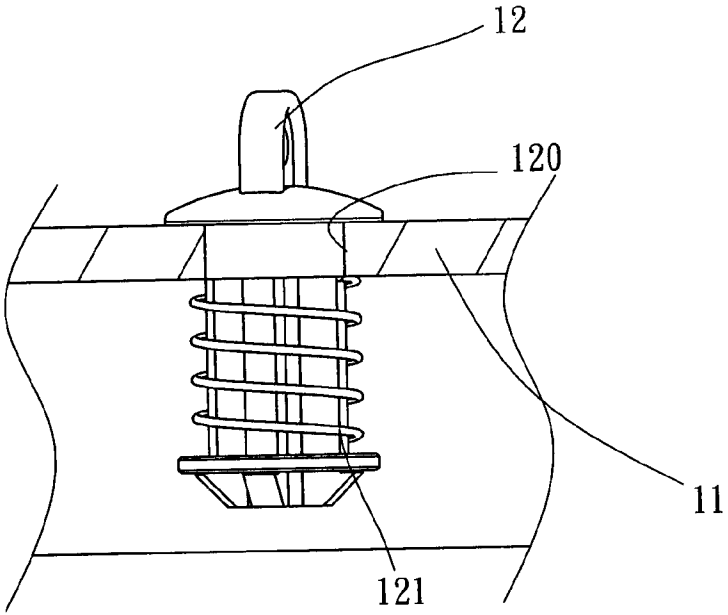

Also referring to FIGS. 3A and 3B, the cover structure 11 has a size substantially corresponding to and thus closing the top opening of the container body 1. The cover structure 11 defines a through hole 120 that receives and retains a relief valve 12. The relief valve 12 comprises a plug-like body (not labeled) movably received in the hole 120 and having expanded top and bottom ends. A biasing element 121, such as a helical spring, is arranged between the expanded bottom end of the valve body 12 and a circumferential edge of the hole 120 of the cover structure 11 to normally close the hole 120 with the top expanded end of the valve 12. When a pressure inside the container body 1 exceeds a predetermined threshold, the spring force of the biasing element 121 is overcome by the internal pressure and the valve body is moved upward to open the hole 120 thereby releasing the internal pressure.

Figure 4:
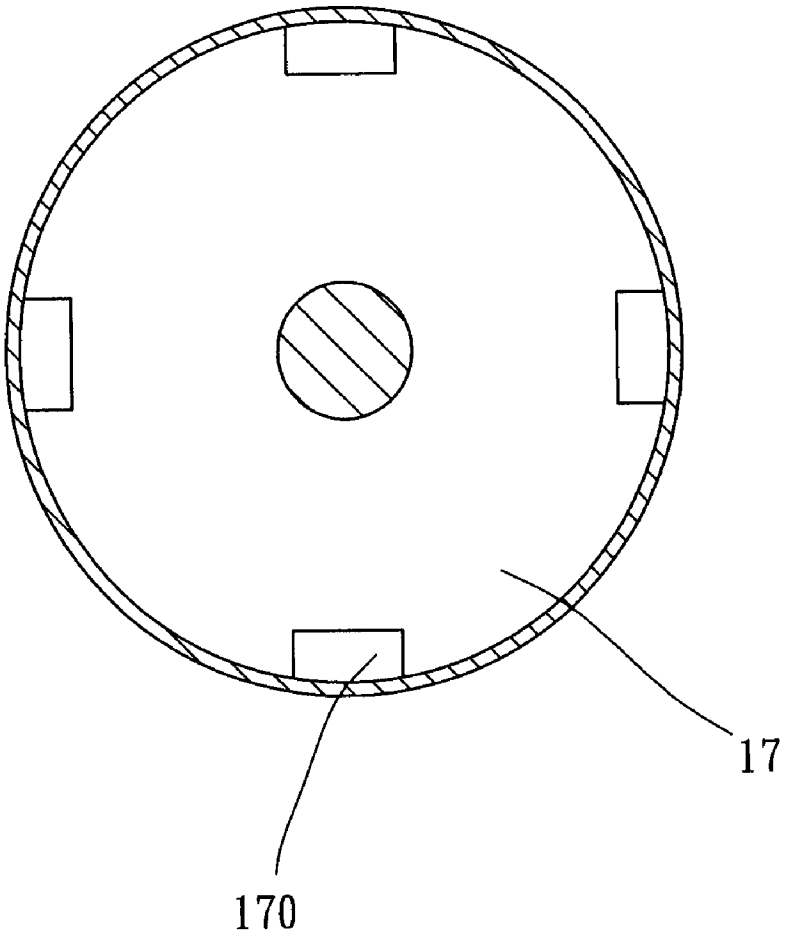
FIG. 4 is a plan view of a piston of the pumping device of the present invention.

A support frame 13 is arranged inside the container body 1 to maintain the container body 1 in an expanded condition without undesired deformation and/or collapse. A piston shaft 14 is formed inside the frame 13, extending between top and bottom of the container body 1. A piston 17 is movably received in the shaft 14. A piston rod 16 is mounted to and extends from the piston 17 with an upper free end projecting beyond the cover structure 11 for manual operation of moving the piston 17 inside the shaft 14. Notches 170 are defined along a circumference of the piston 17 (see FIG. 4) for balance of pressure during the movement of the piston 17 inside the shaft 14 and thus easing the operation of the piston rod 16.

A first transversely extending channel 15 is defined in the bottom of the container body 1. The first channel 15 has an inner end in fluid communication with the piston shaft 14 and an outer end forming an opening in a side face of the bottom of the container body 1. An inner check valve 150 is arranged at the inner end of the first channel 15 and between the first channel 15 and the shaft 14. An outer check valve 151 is mounted to the outer end opening of the first channel 15.

Figure 5:
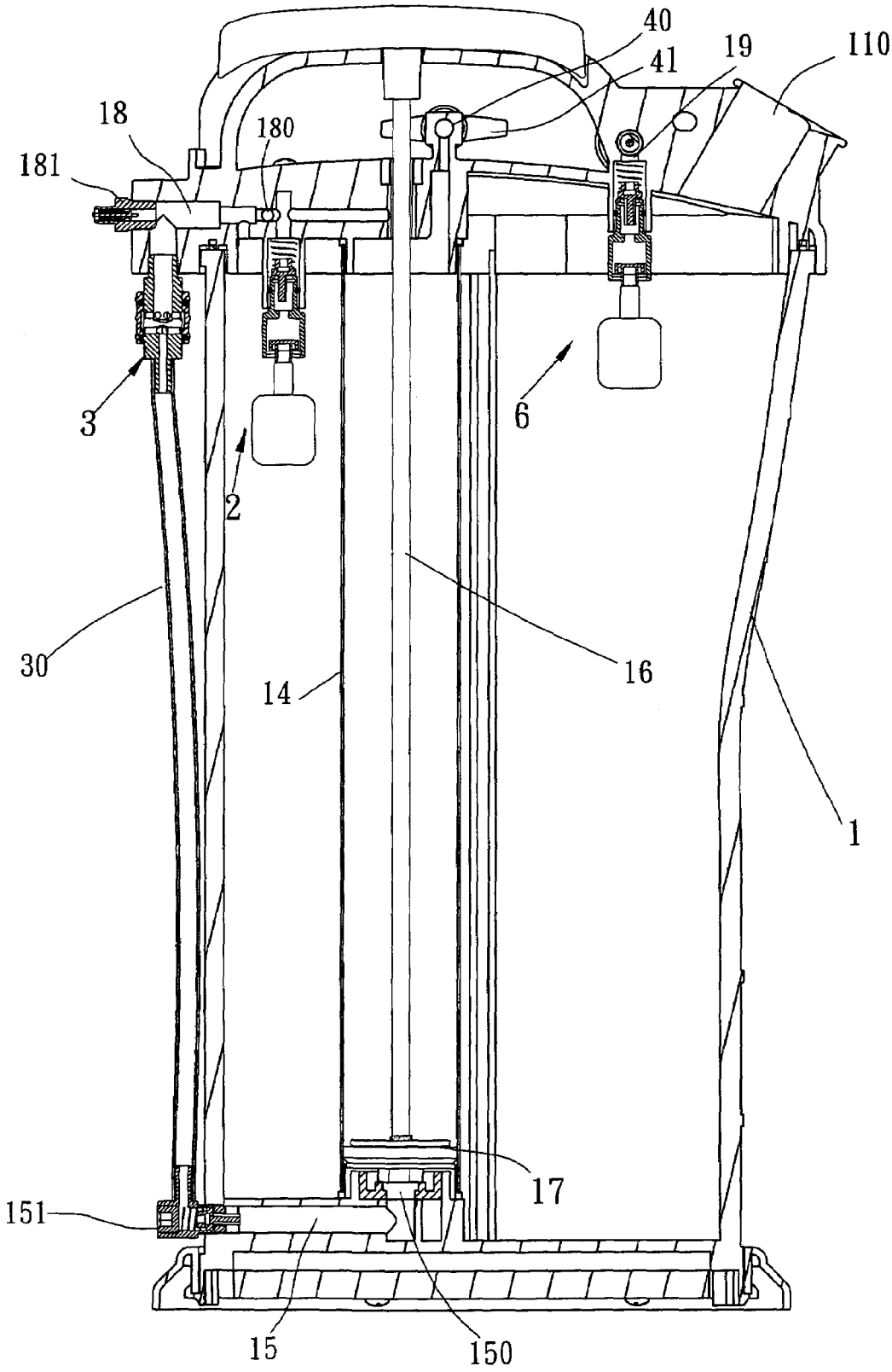
FIG. 5 is a cross-sectional view of the pumping device of the present invention.

Also referring to FIG. 5, a second transversely extending channel 18 is defined in the cover structure 11, having an inner end blocked by a steel ball 180 and an outer end open to the surroundings. A pressurized air nozzle 181 is mounted to the open end of the second channel 18. The second channel 18 is connected to the outer check valve 151 of the first channel by a conduit 30 that is connected to the second channel 18 by a slide switch 3. A first floater switch 2 is arranged inside the container body 1 and is connected to the second channel 18.

Figure 6:
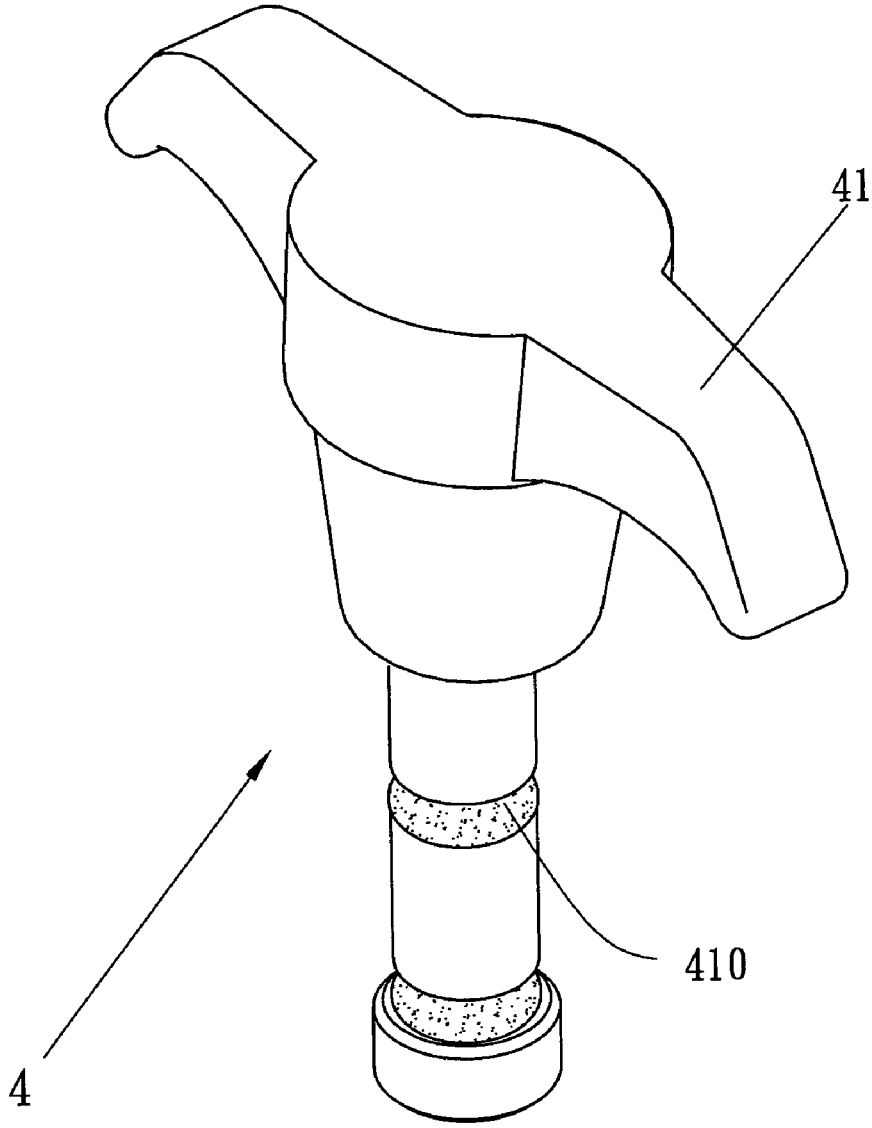
FIG. 6 is a perspective view of a control handle of the pumping device of the present invention.

Also referring to FIGS. 5 and 6, the cover structure 11 comprises an air inlet valve 4, comprising a base 40 formed on the cover structure 11. Defined in the base 40 is a T-shaped air channel including an upper transverse passage and a vertical passage in fluid communication with each other. A control handle 41, particularly shown in FIG. 6, has a stem section (not labeled) movably received in the transverse passage of the T-shaped air channel. At least one groove or recess 410 is defined in the stem section, which, when the control handle 41 is manually moved, selectively blocks or opens the T-shaped air channel of the base 40.

The cover structure 11 further forms a third transversely extending channel 19, spaced from the second channel 18. The third channel 19 has opposite open ends to which a combination of a second slide switch 5 and a vacuum generator 50, and a pressurized air control valve 51 are mounted, respectively. A second floater switch 6 is arranged inside the container body 1 and is connected to the third channel 19.

Figure 7:
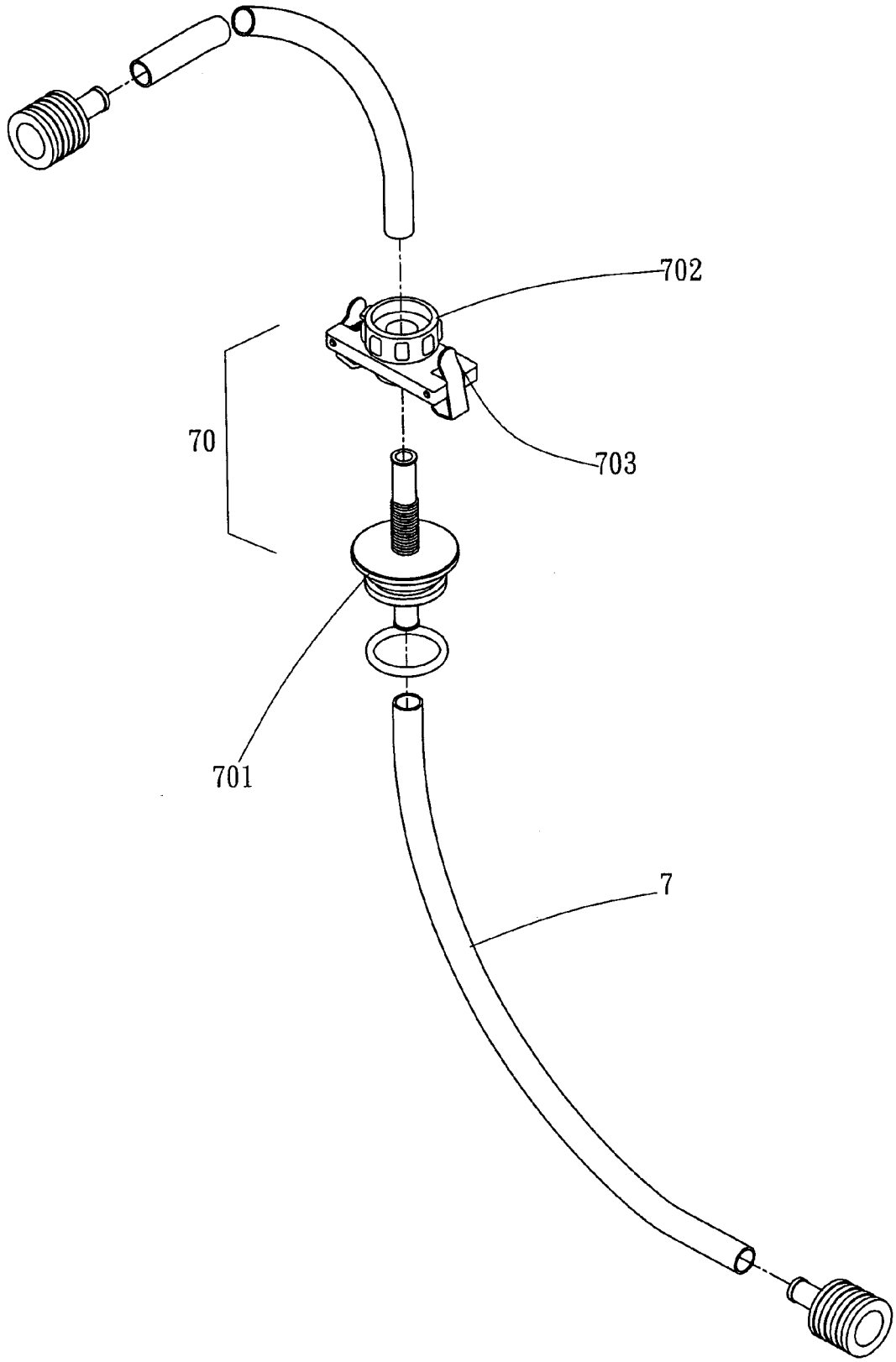
FIG. 7 is an exploded view of an oil hose of the pumping device of the present invention.

Also referring to FIG. 7, a wide opening 110 is formed in the cover structure 11 and communicates the interior of the container body 1. An oil hose 7 extends through the opening 110 into the container body 1 and comprises a fastening structure 70 that fixes the oil hose 7 to the opening 110 of the cover structure 11. The fastening structure 70 includes an anchoring base 701, a rotatable member 702 and a clamp 703 including side wings on opposite sides of the rotatable member 702. The rotatable member 702 and the anchoring base 701 are threadingly tightened together and are then fixed to a side flange of the opening 110 by the clamp 703 by further rotating the rotatable member 702.

Figure 8:
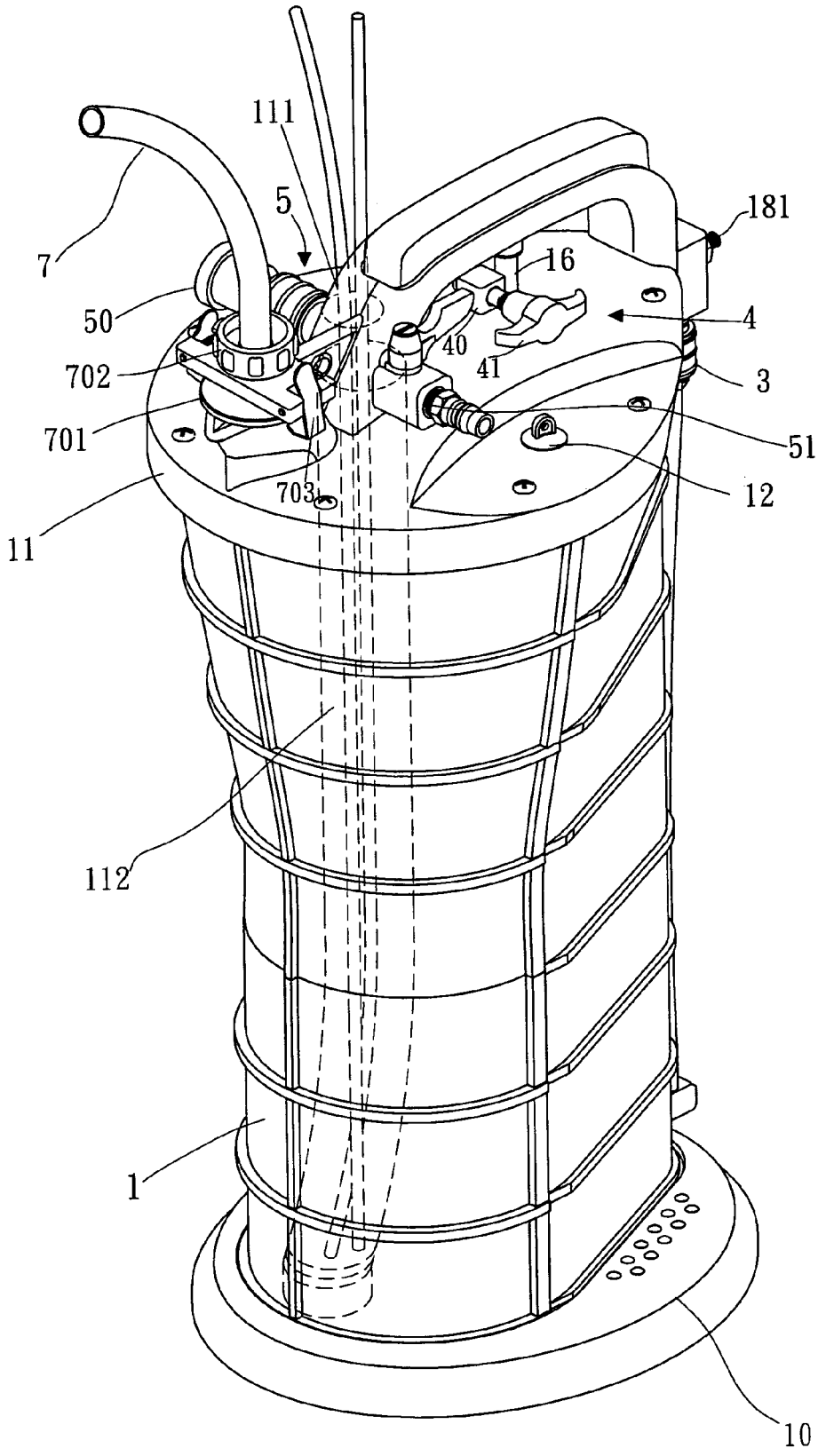
FIG. 8 is a perspective view of the pumping device showing pipes stored in a storage chamber formed inside a container body of the pumping device.

A storage chamber 112 in the form of an elongate tube having a closed bottom end is arranged inside the container body 1. The storage chamber 112 forms a receptacle opening in the cover structure 11, for receiving and retaining oil tubes and tools as shown in FIG. 8.

The device with the above described structure provides a pumping device that can be operated both manually and pneumatically for oil take-in and oil drainage, of which the operation will be described.

Figure 9:
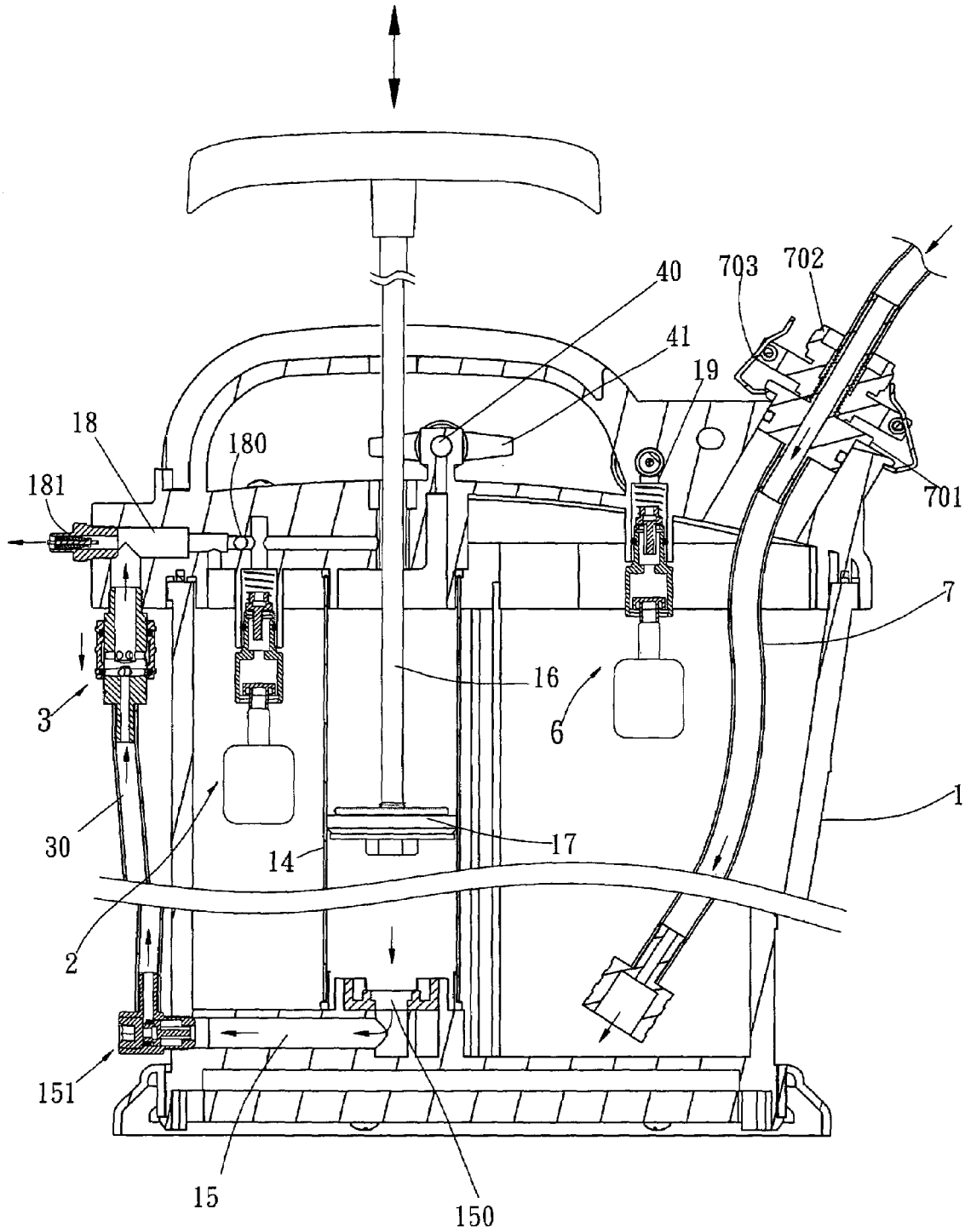
FIG. 9 is a cross-sectional view illustrating manual operation of oil suction with the pumping device of the present invention.

Referring to FIG. 9, manual operation of oil suction will be described first. To take oil in, the control handle 41 of the air inlet valve 4 is moved to a closed position and blocks the air channel of the base 40 from the surrounding atmosphere. The first slide switch 3 is open to establish communication with the atmosphere. The piston 17 is manually reciprocated in the piston shaft 14 and air inside the container body 1 is successfully expelled out of the container body 1 through the first channel 15, the conduit 30, and the first slide switch 3 that is now open to the surroundings. The check valves 150, 151 prevent reverse flow of air into the container body 1 during the expulsion of the air inside the container body 1. A negative pressure or vacuum is thus formed inside the container body 1, which sucks oil into the container body 1 through the oil hose 7.

Figure 10:
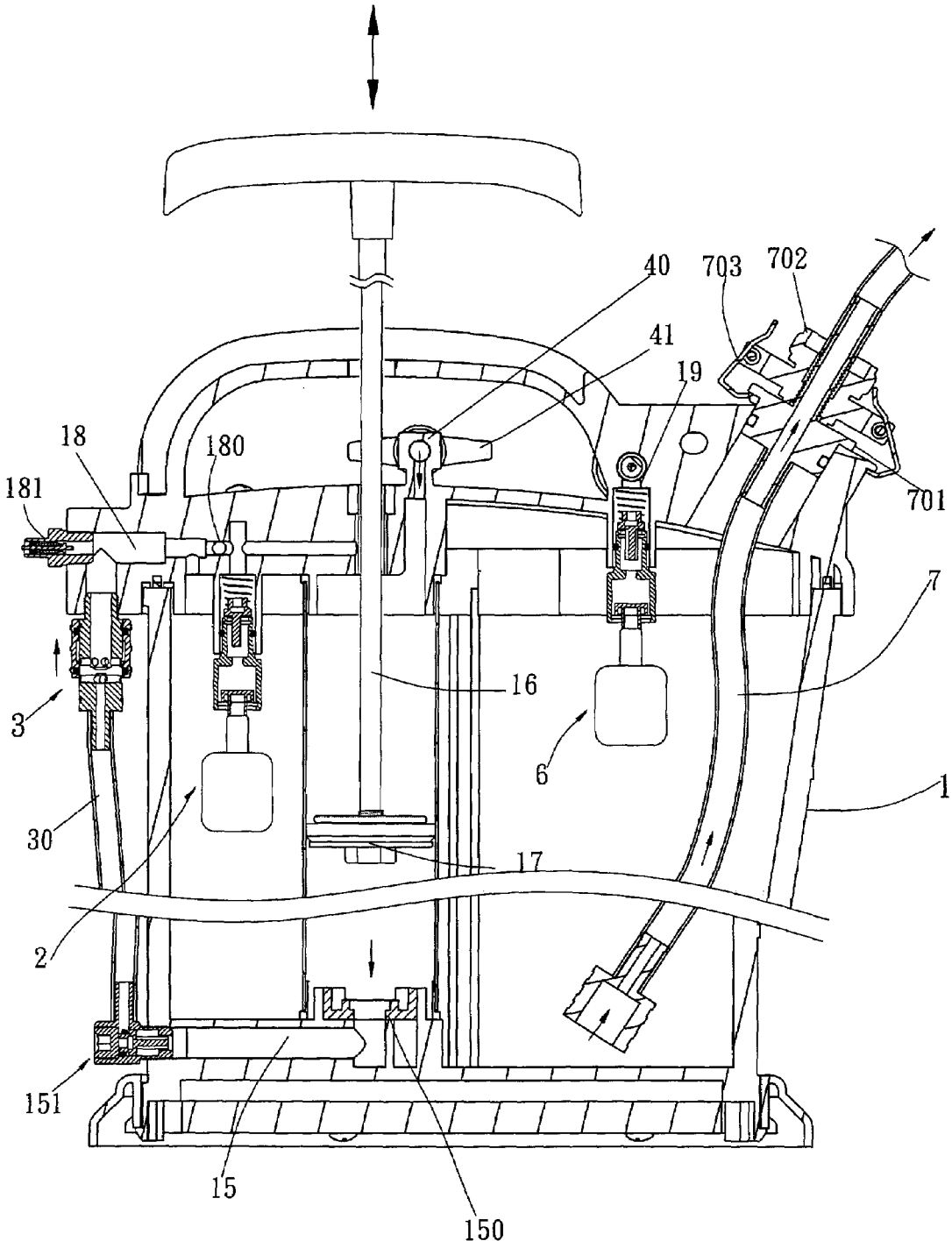
FIG. 10 is a cross-sectional view illustrating manual operation of oil drainage with the pumping device of the present invention.

Referring now to FIG. 10, with which a manual drainage of oil will be explained, the control handle 41 of the air inlet valve 4 is moved to an open position to allow communication of the channel of the base 40 with the surrounding atmosphere. The first slide switch 3 is shut off. The communication of the interior of the container body 1 with the surrounding atmosphere is blocked by the steel ball 180 inside the second channel 18. By manually and reciprocally moving the piston 17 with the aid of the piston rod 16 inside the shaft 14, the surrounding air is taken into the container body 1 through the air inlet valve 4. Consequently, internal pressure inside the container body 1 is continuously increased, which pressurizes the oil contained inside the container body 1 and eventually forces the oil to drain out of the container body 1 through the hose 7.

Figure 11:
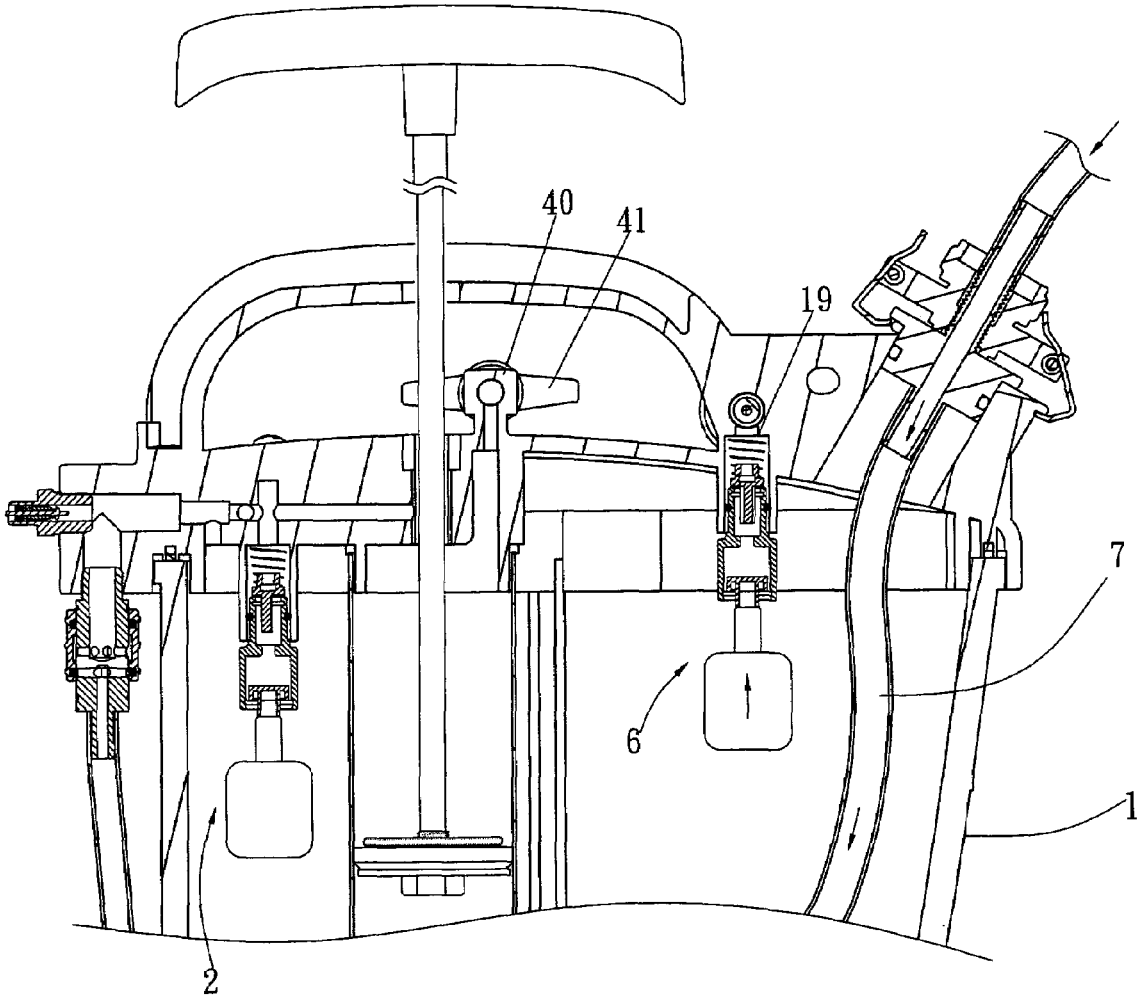
FIG. 11 is a cross-sectional view illustrating pneumatically operated oil suction with the pumping device of the present invention.
Figure 11A:
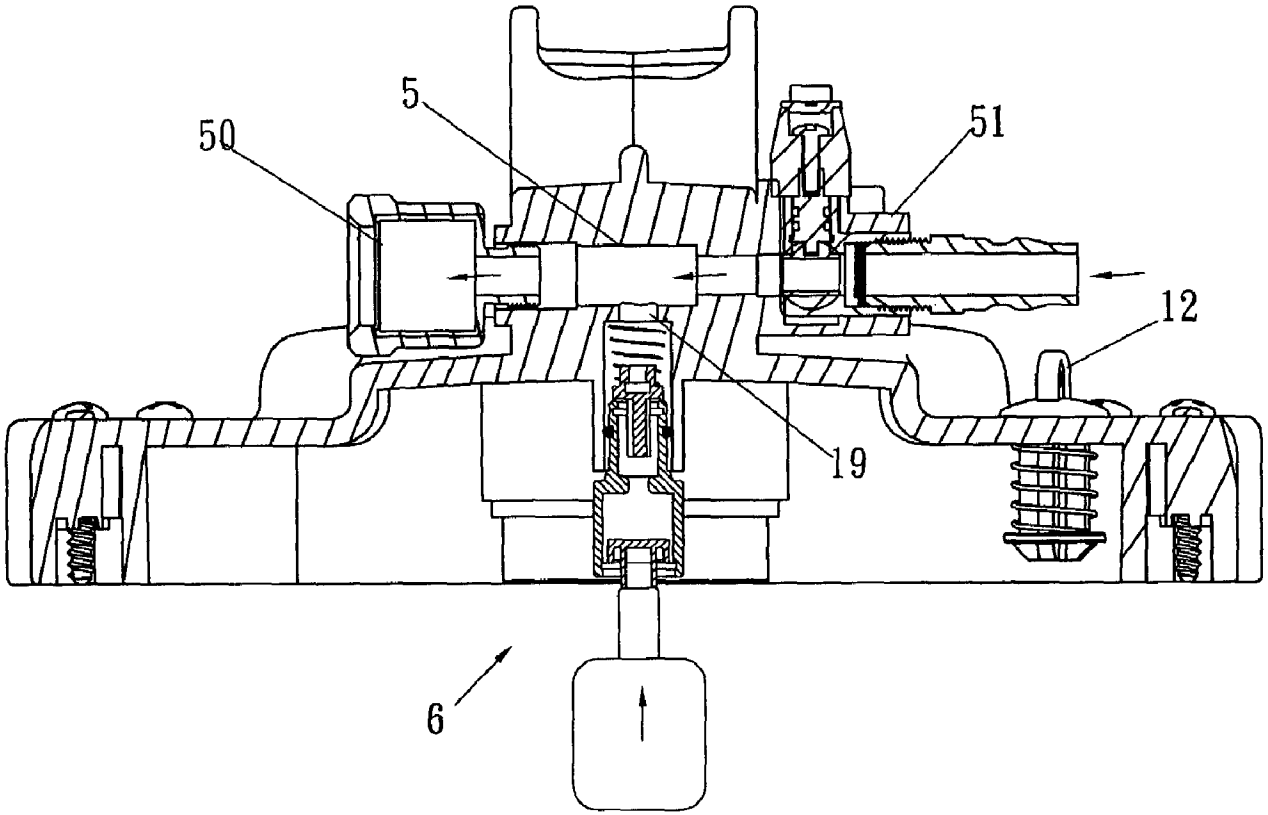

Referring now to FIG. 11, oil can be sucked into the container body 1 in a pneumatic manner, rather than manually. The pressurized air control valve 51 is opened to receive pressurized air from a pressurized air source. The pressurized air passes through the second slide switch 5 and the vacuum generator 50, forming a negative pressure or vacuum inside the third channel 19, which vacuum moves a one-way valve member of the second floater switch 6 to such a position where a gap is formed. Air inside the container body 1 is discharged through the gap and a vacuum is induced inside the container body 1 to such oil into the container body 1 through the hose 7.

Figure 12:
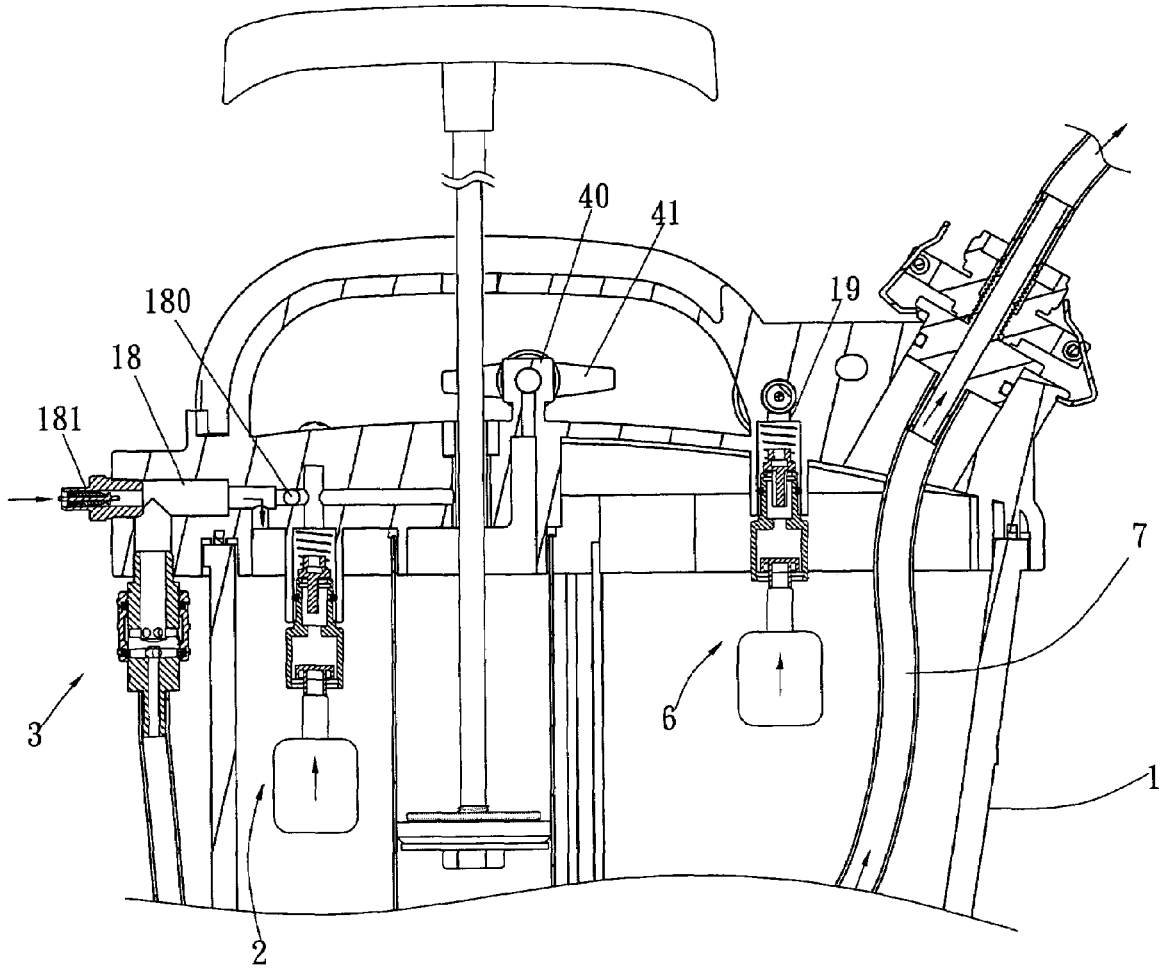
FIG. 12 is a cross-sectional view illustrating pneumatically operated oil drainage with the pumping device of the present invention.

Referring to FIG. 12, pneumatic drainage will now be explained. The first slide switch 3 is shut off. Pressurized air is supplied to the pressurized air nozzle 181 and flows through the second channel 18. With one-way valve members of the floater switches 2, 6 moved upward to shut off the switches 2, 6, the pressurized air are trapped in the container body 1, which increases the internal pressure of the container body 1 and thus expelling the oil contained inside the container body 1 out of the container body 1 through the hose 7.

Figure 13:
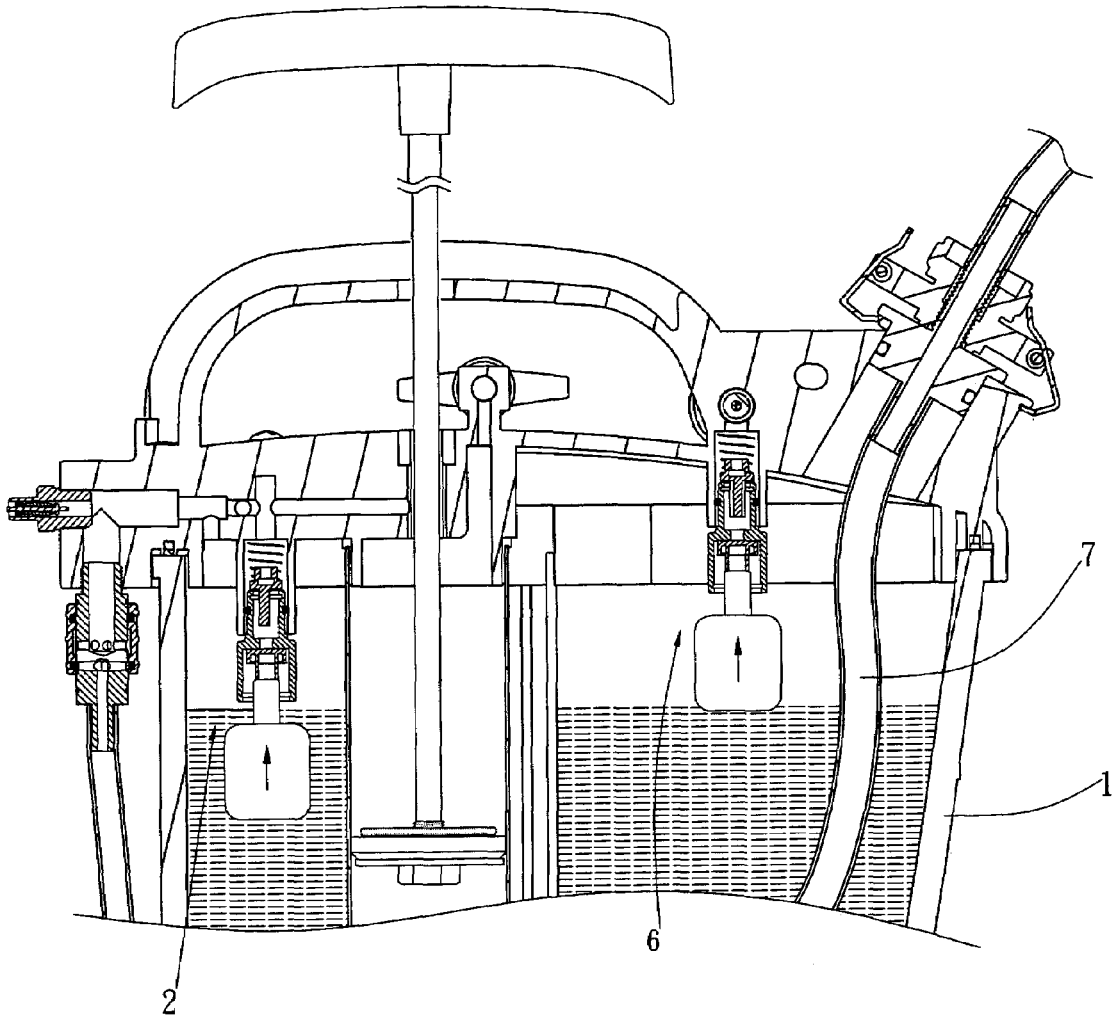
FIG. 13 is a cross-sectional view illustrating operation of floater switches in case that an oil container is full of oil during the suction operation.

It is noted that the floater switches 2, 6 function as a safety device, which, when the container body 1 is full of oil in the oil suction operation, both manual oil suction and pneumatic oil suction, are driven upward by the buoyancy thereof to block the channels for air and thus stopping suction of further oil into the container body 1. This is illustrated in FIG. 13.

Although the present invention has been described with reference to the preferred embodiment with reference to the drawings thereof, it is apparent to those skilled in the art that a variety of modifications and changes may be made without departing from the scope of the present invention which is intended to be defined by the appended claims.

What is claimed is:

1. A pumping device comprising:

a container body having a bottom base adapted to fix on a fixture surface and an open top to which a cover structure is mounted;

a support frame arranged inside the container body, a piston shaft being formed in the frame, a piston being movably received in the shaft and coupled to a piston rod which has a free end extending beyond the cover structure for manual operation;

a first channel defined in the bottom of the container body and having an inner end in fluid communication with the piston shaft with an inner check valve therebetween, the first channel having an outer end to which an outer check valve is mounted;

a second channel defined in the cover structure and connected to the outer check valve by a conduit that is connected to the second channel by a first slide switch;

an air inlet valve comprising a base formed on the cover structure and defining a T-shaped air channel having a transverse passage in which a control handle is movably received, the control handle forming at least one recesses which is positionable to selectively open and close the T-shaped air channel;

a third channel defined in the cover structure and spaced from the second channel, the third channel having a first end to which a combination of second slide switch and vacuum generator is mounted and an opposite second end to which a pressurized air control valve is mounted;

a floater switch arranged inside the container body and connected to the third channel; and wherein by selectively setting the air inlet valve and the first slide switch, air is selectively drawn into and expelled out of the container body to selectively increase and decrease internal pressure of the container body, which in turn sucks oil into the container body or drains oil out of the container body through an opening defined in the cover structure; and wherein by selectively setting the first and second slide switches to supply pressurized air to the container body, internal pressure of the container body is selectively increased and decreased to suck oil into the container body or drain oil out of the container body through the opening defined in the cover structure.

2. The pumping device as claimed in claim 1, wherein the cover structure defines a through hole in which a relief valve is mounted, the relief valve comprising a plug-like body movably received in the hole and a biasing element between the body and the cover structure to normally close the hole an expanded end of the body and to open the hole when the internal pressure of the container body exceeds a threshold determined by the biasing element.

3. The pumping device as claimed in claim 1, wherein the piston has a circumference in which a plurality of notches is defined for pressure balance during the movement of the piston in the piston shaft.

4. The pumping device as claimed in claim 1 further comprising an oil hose extending through the opening defined in the cover structure and comprising a fastening device that attaches the oil hose to the opening, the fastening device comprising an anchoring base and a rotatable member, which are threadingly tightened together, and clamping means on opposite sides of the rotatable member and engageable with a side flange of the opening to fix the hose to the opening of the cover structure.

5. The pumping device as claimed in claim 1, wherein the cover structure forms a receptacle opening that communicates with a storage chamber formed inside the container body for storages of pipes and tools.

* * * * *